US008661564B2

(12) United States Patent
Dodd

(10) Patent No.: US 8,661,564 B2
(45) **Date of Patent: *Mar. 4, 2014**

(54) PROTECTIVE ARTICLES HAVING A PLURALITY OF CORE MEMBERS

(75) Inventor: Mark D. Dodd, Allen, TX (US)

(73) Assignee: Pinwrest Development Group, LLC., New York, NY (US)

( * ) Notice: Subject to any disclaimer, the term of this patent is extended or adjusted under 35 U.S.C. 154(b) by 555 days.

This patent is subject to a terminal disclaimer.

(21) Appl. No.: 12/471,252

(22) Filed: May 22, 2009

(65) Prior Publication Data

US 2009/0276933 A1 Nov. 12, 2009

Related U.S. Application Data

(63) Continuation-in-part of application No. 11/057,954, filed on Feb. 15, 2005, now Pat. No. 8,220,072.

(60) Provisional application No. 61/055,295, filed on May 22, 2008.

(51) Int. Cl.
*A41D 13/00* (2006.01)

(52) U.S. Cl.
USPC ..... 2/22

(58) Field of Classification Search
USPC ..... 2/242, 46, 455, 911, 81, 82, 227, 231, 2/269, 22, 23, 24; 602/5, 12, 23, 36, 62, 602/78
See application file for complete search history.

(56) References Cited

U.S. PATENT DOCUMENTS

| | | | | | |
|---|---|---|---|---|---|
| 1,243,230 | A | * | 10/1917 | Smith | 602/6 |
| 1,683,226 | A | * | 9/1928 | Zuck | 2/272 |
| 3,514,784 | A | | 6/1970 | McDavid | |
| 3,528,412 | A | | 9/1970 | McDavid | |
| 3,772,704 | A | * | 11/1973 | Carbonneau | 2/22 |
| 3,867,239 | A | * | 2/1975 | Alesi et al. | 428/48 |
| 4,115,902 | A | * | 9/1978 | Taylor | 16/221 |
| 4,191,192 | A | | 3/1980 | McDavid | |
| 4,272,850 | A | * | 6/1981 | Rule | 2/24 |
| 4,306,315 | A | | 12/1981 | Castiglia | |
| 4,538,301 | A | * | 9/1985 | Sawatzki et al. | 2/467 |
| 4,805,606 | A | | 2/1989 | McDavid, III | |
| 4,870,956 | A | * | 10/1989 | Fatool et al. | 602/26 |

(Continued)

FOREIGN PATENT DOCUMENTS

WO WO 01/15892 3/2001

OTHER PUBLICATIONS

International Search Report and Written Opinion date mailed Jul. 3, 2008; PCT International Application No. PCT/US06/04757.

(Continued)

*Primary Examiner* — Khoa Huynh
*Assistant Examiner* — Anna Kinsaul
(74) *Attorney, Agent, or Firm* — Patent Capital Group

(57) ABSTRACT

A protective guard for reducing injury to a shin of a person includes a conformable substrate and a plurality of core members disposed adjacent to a surface of the conformable substrate. The plurality of core members are arranged such that a first of the core members is rotationally movable about at least one axis relative to a second of the core members. A flexible fabric membrane comprised of natural or synthetic fibers is positioned adjacent to at least one of the conformable substrate and the plurality of core members.

16 Claims, 7 Drawing Sheets

(56) References Cited

U.S. PATENT DOCUMENTS

| | | | | | |
|---|---|---|---|---|---|
| 4,923,728 | A | * | 5/1990 | Snedeker | 428/52 |
| 5,007,111 | A | | 4/1991 | Adams | |
| 5,105,473 | A | * | 4/1992 | Valtakari | 2/461 |
| 5,301,370 | A | * | 4/1994 | Henson | 2/22 |
| 5,477,558 | A | * | 12/1995 | Volker et al. | 2/461 |
| 5,518,802 | A | * | 5/1996 | Colvin et al. | 428/178 |
| 5,581,805 | A | | 12/1996 | Rennick | |
| 5,625,896 | A | | 5/1997 | LaBarbera et al. | |
| 5,680,657 | A | * | 10/1997 | Valtakari | 2/455 |
| 5,689,836 | A | | 11/1997 | Fee et al. | |
| 5,797,865 | A | | 8/1998 | McDavid, III | |
| 5,890,224 | A | | 4/1999 | Clarik | |
| 5,915,528 | A | | 6/1999 | Shmuelov | |
| 5,926,844 | A | | 7/1999 | Bear | |
| 5,956,777 | A | * | 9/1999 | Popovich | 2/424 |
| 6,058,503 | A | | 5/2000 | Williams | |
| 6,093,468 | A | | 7/2000 | Toms | |
| 6,094,743 | A | * | 8/2000 | Delgado | 2/16 |
| 6,286,150 | B1 | * | 9/2001 | Miller et al. | 2/232 |
| 6,295,654 | B1 | * | 10/2001 | Farrell | 2/456 |
| 6,507,955 | B1 | | 1/2003 | Fee et al. | |
| 6,519,781 | B1 | * | 2/2003 | Berns | 2/267 |
| D472,678 | S | | 4/2003 | Cho | |
| 6,589,891 | B1 | | 7/2003 | Rast | |
| 6,654,960 | B2 | | 12/2003 | Cho | |
| 6,726,641 | B2 | * | 4/2004 | Chiang et al. | 602/5 |
| 6,807,891 | B2 | * | 10/2004 | Fisher | 89/36.02 |
| 6,969,548 | B1 | | 11/2005 | Goldfine | |
| 7,093,301 | B1 | | 8/2006 | Moore, Jr. | |
| D582,608 | S | * | 12/2008 | Palmer | D29/121.1 |
| 7,464,414 | B2 | * | 12/2008 | McDuff | 2/455 |
| D610,312 | S | * | 2/2010 | Farrell | D29/100 |
| D617,503 | S | * | 6/2010 | Szalkowski et al. | D29/122 |
| 8,220,072 | B2 | | 7/2012 | Dodd | |
| 2004/0019950 | A1 | | 2/2004 | Rast | |
| 2006/0179538 | A1 | * | 8/2006 | Dodd | 2/22 |
| 2011/0113559 | A1 | | 5/2011 | Dodd | |
| 2012/0272426 | A1 | * | 11/2012 | Dodd | 2/22 |

OTHER PUBLICATIONS

TEKNOR APEX Thermoplastic Elastomer Division; "Monoprene TPE"; pp. 1-8; Jul. 2004; www.teknorapex.com.

Non-Final Office Action date mailed Feb. 6, 2008 for U.S. Appl. No. 11/057,954.

Response filed May 13, 2008 to Non-Final Office Action date mailed Feb. 6, 2008 for U.S. Appl. No. 11/057,954.

Restriction Requirement date mailed Sep. 17, 2008 for U.S. Appl. No. 11/057,954.

Response filed Oct. 17, 2008 to Restriction Requirement date mailed Sep. 17, 2008 for U.S. Appl. No. 11/057,954.

Non-Final Office Action date mailed Feb. 3, 2009 for U.S. Appl. No. 11/057,954.

Response filed Jul. 6, 2009 to Non-Final Office Action date mailed Feb. 3, 2009 for U.S. Appl. No. 11/057,954.

Final Office Action date mailed Nov. 10, 2009 for U.S. Appl. No. 11/057,954.

Response after Final filed Jan. 11, 2010 to Final Office Action date mailed Nov. 10, 2009 for U.S. Appl. No. 11/057,954.

Response after Final filed Jan. 11, 2010 for U.S. Appl. No. 11/057,954.

Non Final Office Actions issued Mar. 31, 2010 for U.S. Appl. No. 11/057,954.

Response to Office Action filed Jun. 30, 2010 for U.S. Appl. No. 11/057,954.

Restriction Requirement date mailed Sep. 14, 2010 for U.S. Appl. No. 11/057,954.

Response to Non-Final office action filed Feb. 24, 2011 for U.S. Appl. No. 11/057,954.

Response to Restriction Requirement filed Jun. 10, 2011 for U.S. Appl. No. 11/057,954.

Restriction Requirement mailed May 10, 2011 for U.S. Appl. No. 11/057,954.

Notice of Allowance in U.S. Appl. No. 11/057,954 mailed on Sep. 2, 2011.

Request for Continued Examination and Amendment in U.S. Appl. No. 11/057,954, filed Dec. 1, 2011.

Notice of Allowance in U.S. Appl. No. 11/057,954 mailed on May 24, 2012.

Non-Final Office Action in U.S. Appl. No. 13/545,381 mailed on Apr. 11, 2013.

Response to Non-Final Office Action dated Apr. 11, 2013 in U.S. Appl. No. 13/545,381, filed Aug. 12, 2013.

Notice of Allowance in U.S. Appl. No. 13/545,381 mailed on Aug. 28, 2013.

Restriction Requirement in U.S. Appl. No. 12/945,627 mailed on Sep. 6, 2013.

Response to Restriction Requirement dated Sep. 6, 2013 in U.S. Appl. No. 12/945,627, filed Sep. 18, 2013.

Non-Final Office Action in U.S. Appl. No. 12/945,627 mailed on Oct. 15, 2013.

* cited by examiner

PROTECTIVE ARTICLES HAVING A PLURALITY OF CORE MEMBERS

CROSS-REFERENCE TO RELATED APPLICATIONS

This application is a continuation-in-part of U.S. patent application Ser. No. 11/057,954, filed Feb. 15, 2005 now U.S. Pat. No. 8,220,072; this application also claims the benefit of U.S. Provisional Application No. 61/055,295, filed May 22, 2008. All of the above applications are hereby incorporated by reference.

BACKGROUND OF THE INVENTION

1. Field of the Invention

The present invention relates generally to protective articles and in particular to protective articles to protect persons, animals, and other non-living articles or items from impact or other forces.

2. Description of Related Art

Guards and other protective equipment is widely used in amateur and professional sports and other activities to protect participants' from injury. For example, in soccer, players often wear shin guards to protect their lower legs in the event that they are kicked by other players during a game. Football players wear protective shoulder and thigh pads to prevent injury due to impact with other players. Baseball players, such as catchers, use protective chest pads to prevent injury if the catcher is struck by the baseball. Without adequate protection in these sports and others, the risk of injury is high. Protective equipment is also used in non-sports settings. One example is the medical industry which uses casts and splints to immobilize and protect areas of a patient's body.

Existing guards and protective equipment provide some protection for the persons or equipment to which the guards are applied, but the guards are typically bulky and uncomfortable. Many times, the guards are a single piece of rigid plastic or other material that is affixed to the protected article. Other times, the guards may be a very thick padding or other material. Obtaining a customized fit between the guard and the protected article is often impossible. In the case of person's wearing the guard, this lack of customized fit makes the guards less comfortable to wear, and the guards could under some circumstances impede the movement of the person. Finally, a guard that does not fit properly also fails to provide maximum impact protection to a person.

SUMMARY

The problems presented by existing protective guards are solved by the systems and methods of the illustrative embodiments described herein. In one embodiment, a protective guard includes an elastomeric sheath having a pocket disposed therein. The protective guard further includes a central core having a plurality of rigid plates. The central core is disposed within the pocket of the elastomeric sheath. The plurality of rigid plates includes a first plate that is joined by at least one hinge to a second plate.

In another embodiment, a protective guard having a conformable substrate and a plurality of core members is provided. The plurality of core members are at least partially embedded within the conformable substrate. The core members are arranged such that a first of the core members is rotationally movable about at least one axis relative to a second of the core members.

In still another embodiment, a protective guard is provided that includes a conformable substrate and a plurality of core members disposed adjacent to a surface of the conformable substrate. The core members are arranged such that a first of the core members is rotationally movable about at least one axis relative to a second of the core members.

In yet another embodiment, a protective guard is provided that includes an elastomeric substrate and a plurality of non-elastomeric core members. The non-elastomeric core members are at least partially embedded within the elastomeric substrate.

Other objects, features, and advantages of the illustrative embodiments will become apparent with reference to the drawings, detailed description, and claims that follow.

DETAILED DESCRIPTION OF THE ILLUSTRATIVE EMBODIMENT

In the following detailed description of the illustrative embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

As used herein, the term "elastomer" refers to a polymeric, rubber (natural or synthetic), or other material that has elongation rates greater than 100%.

The term "conformable" refers to the ability of a material to be shaped to the contours of a surface without permanently deforming or setting the material. The conformable material could be placed adjacent to a first surface to provide a contour fit to the first surface, and then could subsequently be placed adjacent a second surface and similarly provide a contour fit to the second surface.

Figure 1:
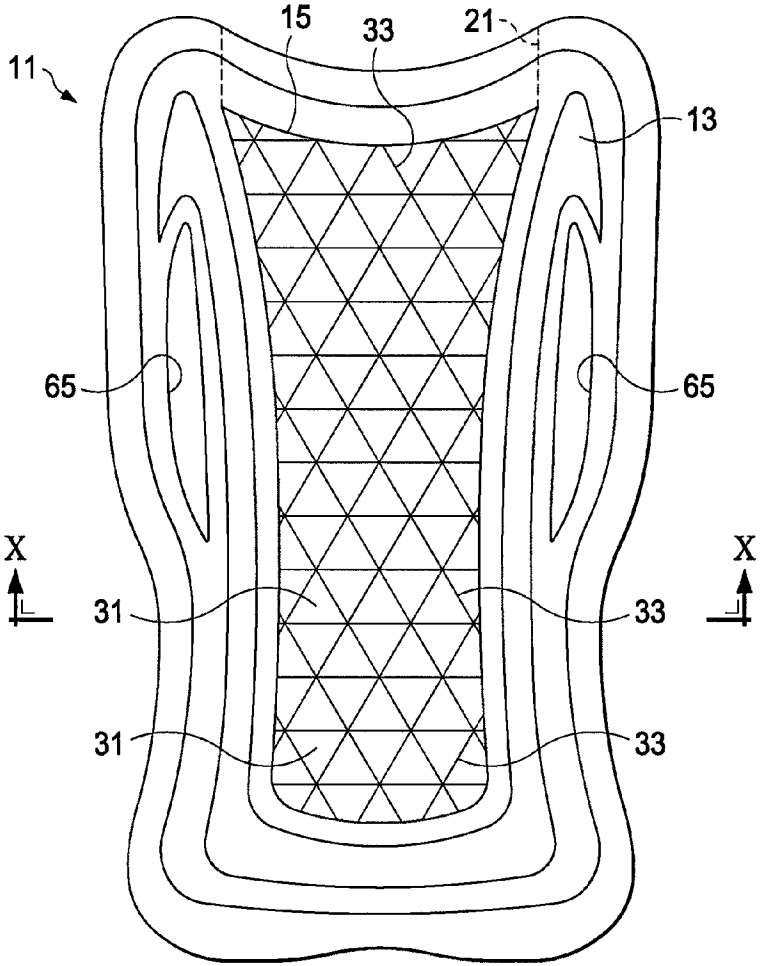
FIG. 1 illustrates a front view of a protective guard according to an illustrative embodiment, the protective guard having a conformable substrate and a central core disposed therein.

Referring to FIG. 1, a protective guard 11 according to the principles of the present invention includes a conformable substrate 13 and a central core 15. The central core 15 is connected to or embedded within the conformable substrate 13 to provide impact protection to a body part of a person. In one embodiment, the conformable substrate 13 may include a pocket 19 (see FIG. 10) within the conformable substrate that houses the central core 15. When the central core 15 is contained within pocket 19, the conformable substrate 13 functions as a sheath, and an entry slot 21 may be optionally provided to allow access to pocket 19, thereby allowing the central core 13 to be selectively removed or inserted into the conformable substrate 13. However, in one embodiment, the pocket 19 is not accessible by an entry slot, thereby creating a sealed space for the conformable substrate 13. The pocket 19 closely matches the shape of the central core 13 and may be formed by molding the conformable substrate 13 around the central core 13.

Figure 2:
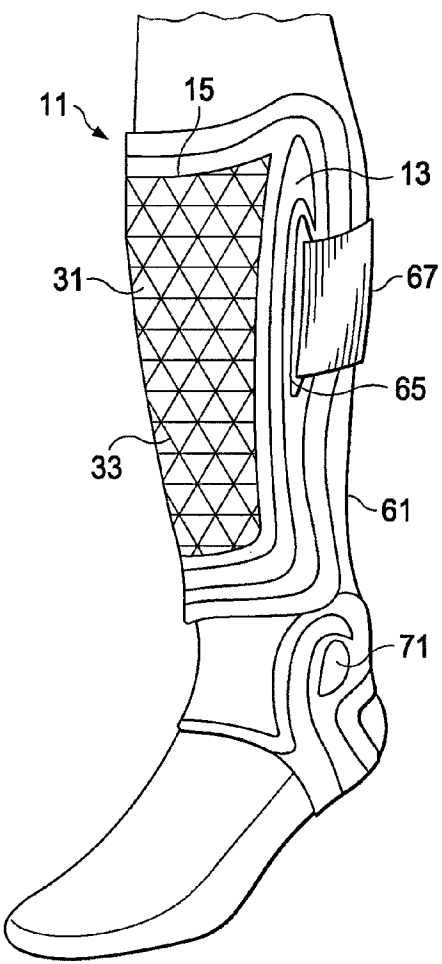
FIG. 2 depicts a perspective view of the protective guard of FIG. 1 secured to a leg of a person.

The conformable substrate 13 may be constructed from an elastomeric material such that the conformable substrate 13 can be easily wrapped around and shaped to the contours of a person's lower leg or shin 61 (see FIG. 2). In one embodiment, the conformable substrate may be made from Monprene MP-1880, a thermoplastic elastomer manufactured by Teknor Apex, Thermoplastic Elastomer Division of Pawtucket, R.I. Other suitable materials may include without limitation other thermoplastic elastomers, ethylene vinyl acetate (EVA), natural rubber, polyisoprene, styrene butadiene rubber, chloroprene rubber, polybutadiene, nitrile rubber, butyl rubber, ethylene propylene rubber, ethylene propylene diene rubber, chlorosulfonated polyethylene, polysulfide rubber, silicone rubber, polyurethane, or open-cell neoprene, energy-absorbent or viscoelastic foam such as a memory foam, or any other conformable material.

Figure 3:
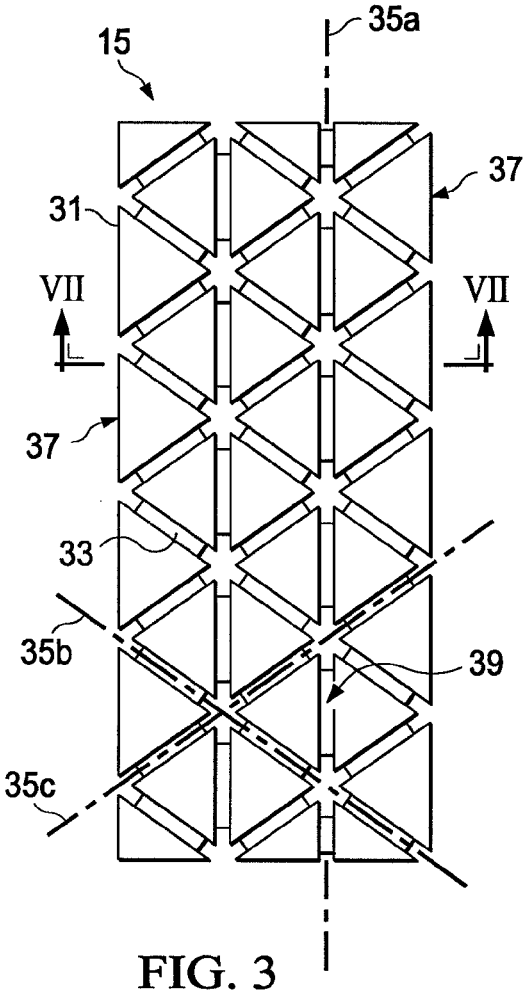
FIG. 3 illustrates a partial front view of the central core of FIG. 1, the central core including a plurality of core members.
Figure 4:
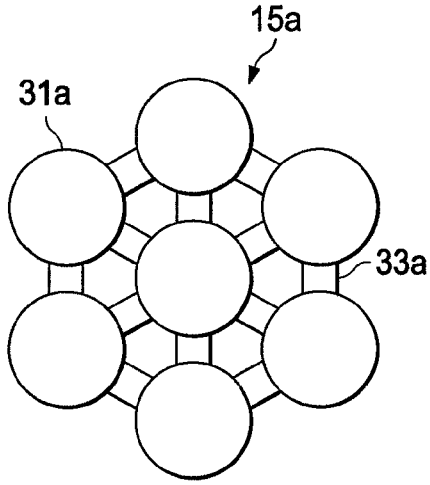
FIG. 4 depicts a partial front view of a plurality of round core members according to an illustrative embodiment.

Referring to FIG. 3, the central core 15 includes a plurality of plate members, or core members 31. In one embodiment, each core member is joined by at least one hinge 33 to another of the core members 31 such that the core members 31 are capable of rotational movement relative to one another. The rotational movement between two core members typically occurs along an axis that is positioned between the core members. When hinges 33 are used to connect the core members 31, the axis of rotation corresponds to the rotational axis of the hinge. Representative axes of rotation for the central core 15 of FIG. 3 are illustrated as axis 35*a*, axis 35*b*, and axis 35*c*. The ability of the core members 31 to rotationally move relative to one another allows the central core 15 to be conformable to a shin or other body part of a person even though the material that forms the core members 31 would not necessarily be conformable if used in a singe piece.

Figure 5:
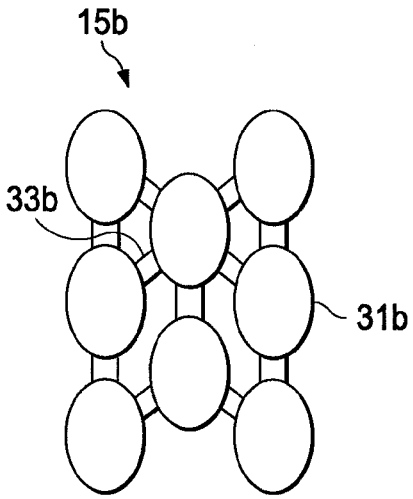
FIG. 5 illustrates a partial front view of a plurality of oval core members according to an illustrative embodiment.
Figure 5A:
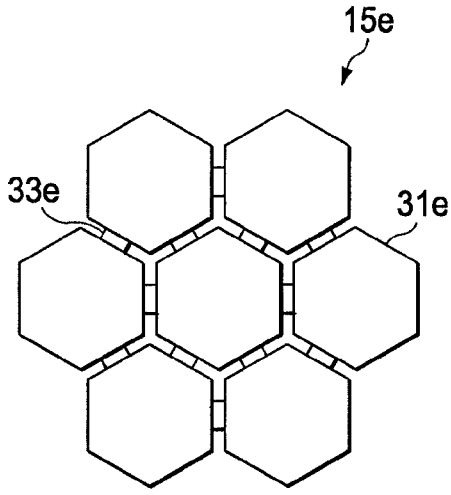
FIG. 5A illustrates a partial front view of a plurality of hexagonal core members according to an illustrative embodiment.
Figure 6:
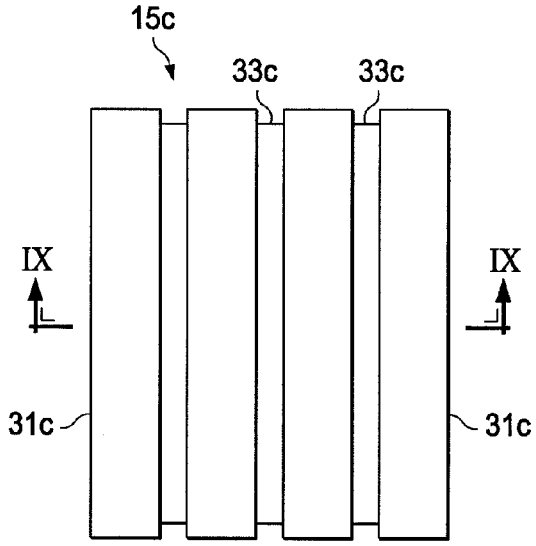
FIG. 6 depicts a partial front view of a plurality of rectangular core members according to an illustrative embodiment.

Referring more specifically to FIGS. 3-6, the core members may be any shape or size. In one embodiment, the core members 31 may be triangular in shape such as is illustrated in FIG. 3. In another embodiment, a central core 15*a* is partially shown in FIG. 4 having round core members 31*a* connected by hinges 33*a*. FIG. 5 partially illustrates a central core 15*b* having a plurality of oval core members 31*b* connected by hinges 33*b*. FIG. 5A partially illustrates a central core 15*e* having hexagonal core member 31*e* connected to hinges 33*e*. FIG. 6 partially illustrates a central core 15*c* having rectangular core members 31*c* connected by hinges 33*c*. Other shapes may include without limitation octagonal, other polygonal, or free-form shapes.

Figure 7:
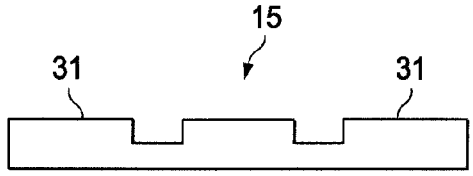
FIG. 7 illustrates a cross-sectional bottom view of the core members of FIG. 3 taken at VII-VII.

Referring to FIG. 7, the core members 31 of protective guard 11 are preferably substantially flat, rigid or semi-rigid plates constructed from a non-elastomeric material. In one embodiment, the core members 31 are made from a hard plastic material such as acrylonitrile butadiene styrene (ABS), styrene, polyethylene, polypropylene, acrylic, polyvinyl chloride (PVC), fluoroplastics, nylon, acetal, polycarbonate, polyimide, polyamide-imide, polyphenylene sulfide, polyarylates, polyethylene terephthalate, polybutylene terephthalate, polyether ether ketone, polysulfone, polyether sulfone, polyetherimide, or polyphenylene oxide. However, it should be understood that any substantially rigid material may be used, including composites, metal, ceramics, synthetic fiber materials such as KEVLAR®, or wood. Although a non-elastomeric material is preferred, the core members 31 may even be formed from an elastomeric material if rotational movement between the core members 31 would allow the elastomeric material to better conform to the shin of a person. Preferably, the material used to form the core members 31, and thus the central core 15, is a material that is compatible with the material chosen for the conformable substrate 13. Since some embodiments involve molding the conformable substrate 13 over the central core 15, it is desirous to use a central core material to which the conformable substrate 13 will adhere. A coating or adhesive may be applied to the central core 15 prior to the molding process to achieve additional adhesion between the central core 15 and the conformable substrate 13.

Figure 9:
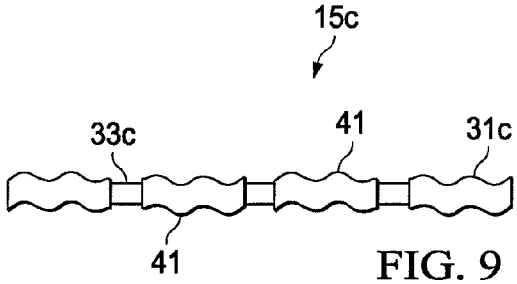
FIG. 9 illustrates a cross-sectional bottom view of the core members of FIG. 6 taken at IX-IX.

Referring to FIG. 9, the central core 15*c* of FIG. 6 is illustrated in cross section and includes core members 31*c* connected by hinges 33*c*. While the core members may be substantially flat so that an impact force directed to the protective guard does not damage the conformable substrate, the core members 31*c* illustrated in FIG. 9 include ridges 41. The ridges 41 may be capable of absorbing additional energy by flattening in the presence of an impact force. Other alternatives to a substantially flat core member may be provided by a core member that is slightly concave or convex in cross section. The core members could alternatively be fluid-filled capsules such as those containing air or gel, or the core members may also be provided in a mesh configuration that is hinged together similar to chain mail armor.

Figure 8:
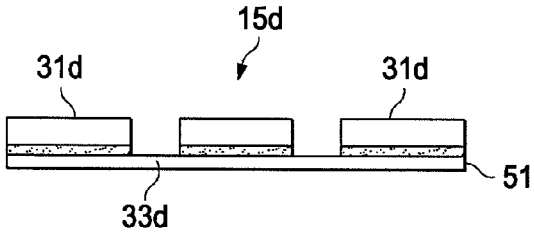
FIG. 8 depicts a cross-sectional bottom view similar to FIG. 7 of a plurality of core members according to an illustrative embodiment.

Referring again to FIG. 7 and also to FIG. 8, the hinges that connect the core members may be provided in several different forms. In one embodiment illustrated in FIG. 7, the hinge 33 is a "living hinge." The living hinge is preferably integrally attached between the core members 31 and is made from the same material as each of the core members 31. The living hinge may be created by machining or etching the core members 31 from a single sheet of material having a relatively constant thickness. The sheet of material is thinned in any region that will become a hinge. This thinning process to create the hinges 33 also creates the general shape of the core members 31. Alternatively, the core members 31 and hinges 33 may be formed by molding or any other manufacturing process, including without limitation injection molding, compression molding, or transfer molding. Living hinges are a strong way of maintaining a rotational connection between core members 31. The living hinges 33 allow repeated rotations between core members 31 while maintaining the relative positions of the core members 31 during the process of assembling the central core 15 and the conformable substrate 13.

Referring to FIG. 8, another option for providing hinges is illustrated in reference to a central core 15*d* having core members 31*d* and hinges 33*d*. Hinges 33*d* are formed by arranging precut core members 31*d* onto a membrane or other material 51 that includes an adhesive or gel to secure the core members 31*d* to the membrane 51. The membrane 51 could be an adhesive tape or other film, a mesh material or alternatively the membrane could be another piece of plastic or elastomer to which the core members 31*d* are bonded. In still another embodiment, the membrane could be a thin layer of the material comprising the conformable substrate. Membrane 51 could be applied to both sides of the core members 31*d* or only on one side as shown in FIG. 8.

Although not illustrated, mechanical, multi-part hinges could also be used to connect adjacent core members.

Referring again to FIG. 3, certain of the core members are located in an outer perimeter region 37, while other of the core members are located in an inner region 39. The core members 31 located in the inner region 39 are preferably connected by hinges 33 along each edge of the core member 31 to each adjacent core member 31. For core members 31 located in the outer perimeter region 37, hinges 33 are only attached to one or two edges of each core member 31. However, regardless of whether a particular core member 31 is disposed within the outer perimeter region 37 or the inner region 39, it is not required that every edge of a core member 31 be connected by a hinge to another core member 31. In fact, hinges are not mandatory. Hinges simply provide a good way to maintain relative positioning of the core members 31 during assembly of the central core 15 and the conformable substrate 13. If the relative positioning of the core members 31 could be maintained without hinges, the fixation of the core members 31 within or to the conformable substrate 13 would allow the desired capability of rotational movement between adjacent core members 31. Alternatives for positioning the core members 31 are discussed below in reference to the assembly of the central core 15 and the conformable substrate 13.

Figure 10:
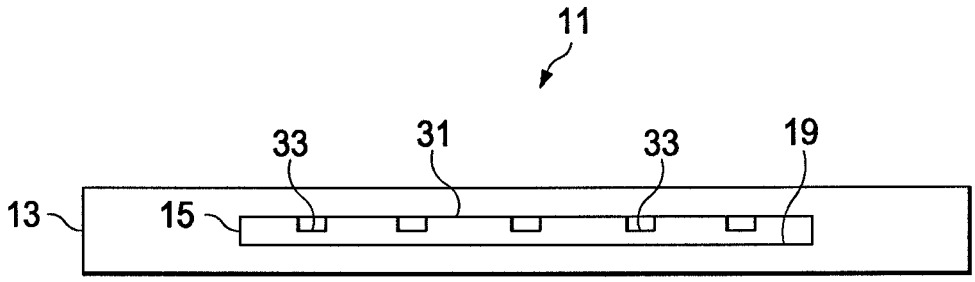
FIG. 10 depicts a cross-sectional bottom view of the conformable substrate and central core of FIG. 1 taken at X-X.

Referring to FIG. 10, in one embodiment, the protective guard 11 includes core members 31 that are completely embedded within the conformable substrate 13. As mentioned previously, a pocket 19 could be provided with an entry slot that allows for insertion of the central core 15 after the conformable substrate 13 is formed. Alternatively, the central core 15 may be molded within the conformable substrate 13, which would automatically form a pocket 19 around the central core 15. It is preferred that hinges 33 are present between the core members 31 to maintain the relative position of the core members 31 during the molding process. It is possible, however, that the core members 31 be individually placed during the molding process to eliminate the need for the hinges 33. After the molding process, the relative positions (e.g. spacing) of the core members 31 would be fixed within the conformable substrate 13, yet the core members 31 would still be capable of rotational movement relative to one another.

Figure 11:
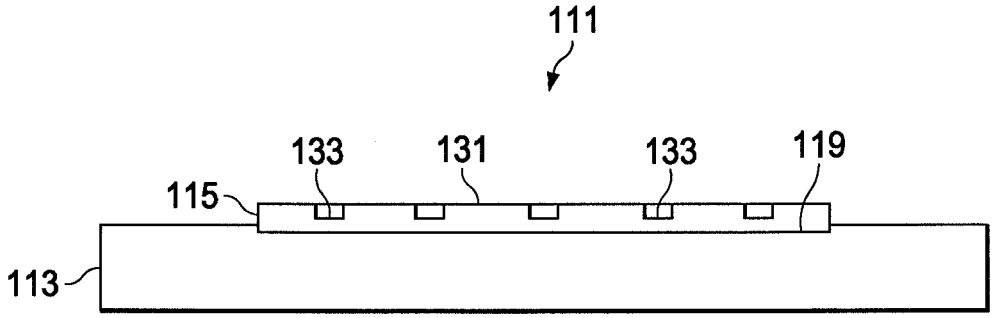
FIG. 11 illustrates a cross-sectional bottom view similar to FIG. 10 of a conformable substrate and central core according to an illustrative embodiment.

Referring to FIG. 11, in another embodiment, a protective guard 111 having a conformable substrate 113 and a central core 115 is illustrated. The central core 115 includes a plurality of core members 131 connected by hinges 133. The central core 115 is partially embedded within a pocket 119 of the conformable substrate 113, thereby exposing the core members 131 near a surface of the conformable substrate 113. The central core 115 may be secured to the conformable substrate 113 by the embedding process, or a bonding agent or any other adhesive or gel may be used to further secure the central core 115. Alternatively, the central core 115 may be attached by sewing means, heat fastening means, ultrasonic fastening means, or any other fastening means. As discussed previously in reference to FIG. 10, the hinges 133 between core members 131 could be eliminated if the core members 131 were individually placed during the assembly process. Individual core members 131 could be placed during the molding of the conformable substrate 113, or the core members could be bonded within the pocket 119 of the conformable substrate 113 after the molding process is complete. After securing the core members 131 to the conformable substrate 113, the relative positions (e.g. spacing) of the core members 131 would be fixed, yet the core members 131 would still be capable of rotational movement relative to one another.

Figure 12:
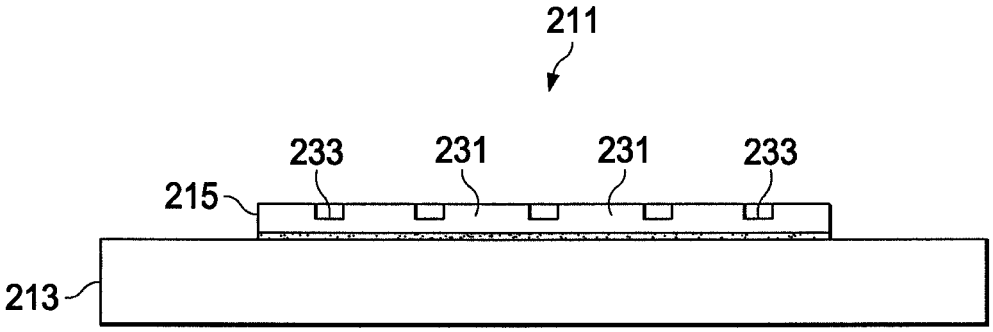
FIG. 12 depicts a cross-sectional bottom view similar to FIG. 10 of a conformable substrate and central core according to an illustrative embodiment.

Referring to FIG. 12, in another embodiment, a protective guard 211 having a conformable substrate 213 and a central core 215 is illustrated. The central core 215 includes a plurality of core members 231 connected by hinges 233. In one embodiment, the central core 215 is bonded to a surface of the conformable substrate 213 by a bonding agent, adhesive, or gel. Alternatively, the central core 215 may be attached to the conformable substrate 213 by sewing means, heat fastening means, ultrasonic fastening means, or any other fastening means. As discussed previously with reference to FIGS. 10 and 11, the hinges 233 between core members 231 could be eliminated if the core members 231 were individually placed during the bonding process. After securing the core members 231 to the conformable substrate 213, the relative positions (e.g. spacing) of the core members would be fixed, yet the core members would still be capable of rotational movement relative to one another.

Figure 13:
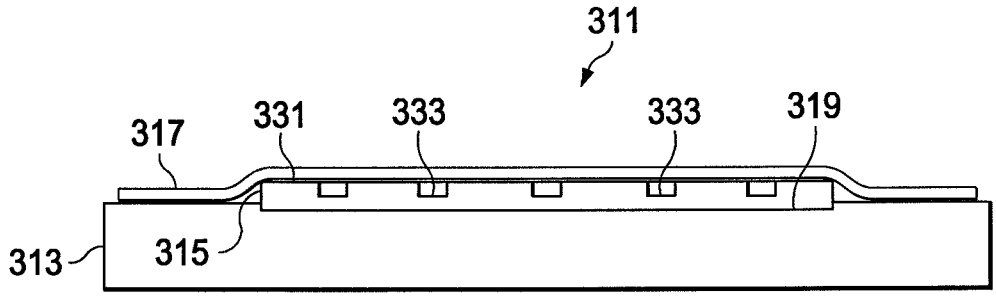
FIG. 13 illustrates a cross-sectional view of a conformable substrate, a central core, and a flexible membrane according to an illustrative embodiment, the cross-sectional view being similar to the cross-sectional view illustrated in FIG. 10.

Referring to FIG. 13, a protective guard 311 according to another embodiment of the invention includes a conformable substrate 313, a central core 315, and a flexible membrane 317. The central core 315 includes a plurality of core members 331 connected by hinges 333. The central core 315 is at least partially embedded within a pocket 319 of the conformable substrate 313, and at least a portion of the central core 315 is covered by flexible membrane 317. While each of the conformable substrate 313, central core 315 and flexible membrane 317 (the three layers) may be adhesively bonded or otherwise attached to the other layers, some of the layers may not be attached to one another. For example, central core 315 may be placed on the conformable substrate 313 without attachment. The flexible membrane 317 may include an adhesive on one side that permits adherence of the flexible membrane 317 to both the central core 315 and the conformable substrate 313, thereby holding the central core 315 in place relative to the conformable substrate 313. Alternatively, the flexible membrane 317 may not be attached to the central core 315 but rather only to the conformable substrate 313. While the pocket 319 could be preformed in the conformable substrate 313 to receive the central core 315, the pocket 319 could instead be formed by an elastic deformation of the conformable substrate 313 in the presence of a compressive force applied by the flexible membrane 317 to the central core 315. If the layers of the protective guard 311 are attached, attachment may be accomplished by a bonding agent or any other adhesive or gel, sewing means, ultrasonic means, heat means, or any other fastening means. As discussed previously in reference to FIG. 10-12, the hinges 333 between core members 331 could be eliminated if the core members 331 were individually placed during the assembly process. Individual core members 331 could be placed during the molding of the conformable substrate 313, or the core members could be bonded within the pocket 319 of the conformable substrate 313 after the molding process is complete. Alternatively, the core members 331 (hinged or unhinged) could be attached to the flexible membrane 317 prior to securing the flexible membrane 317 to the conformable substrate.

Figure 14:
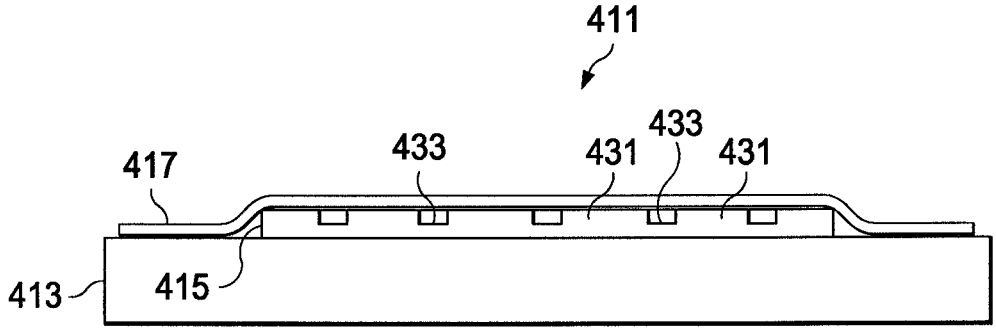
FIG. 14 depicts a cross-sectional view similar to FIG. 13 of a conformable substrate, a central core, and a flexible membrane according to an illustrative embodiment.

Referring to FIG. 14, a protective guard 411 according to another embodiment of the invention includes a conformable substrate 413, a central core 415, and a flexible membrane 417. The layers of protective guard 411 and the methods of attachment are substantially the same as protective guard 311 described in FIG. 13, with the exception that the central core 415 is not embedded within a pocket of the conformable substrate 413. Instead, the central core 415 is attached to or positioned against an outer surface of the conformable substrate 413. The central core 415 is also similar to those previously described in that the central core 415 includes a plurality of core members 431 connected by hinges 433.

Figure 15:
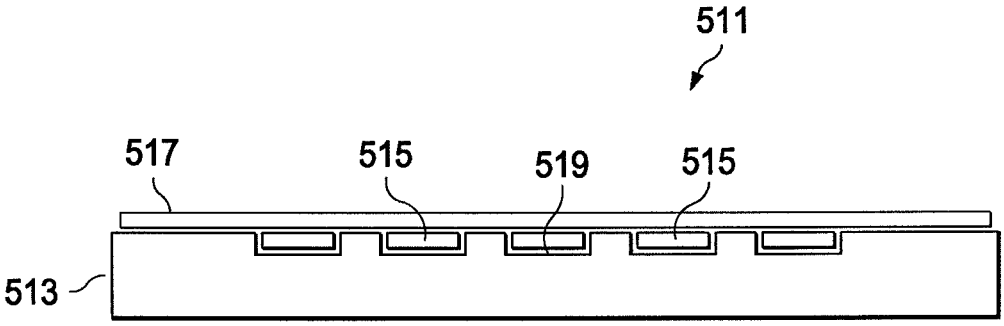
FIG. 15 illustrates a cross-sectional view similar to FIG. 13 of a conformable substrate, a central core, and a flexible membrane according to an illustrative embodiment.

Referring to FIG. 15, a protective guard 511 according to another embodiment of the invention includes a conformable substrate 513, a plurality of core members 515, and a flexible membrane 517. In this embodiment, the core members 515 are not connected by hinges, but rather each core member is placed within a pocket 519 formed in the conformable substrate 513. The flexible membrane 517 is positioned over the conformable substrate 513 and the core members 515 to create a substantially flat impact surface. While each of the conformable substrate 513, the core members 515 and flexible membrane 517 (the three layers) may be adhesively bonded or otherwise attached to the other layers, some of the layers may not be attached to one another. For example, the core members 515 may be placed within the pockets 519 without attachment. The flexible membrane 517 may include an adhesive or gel on one side that permits adherence of the flexible membrane 517 to both the core members 515 and the conformable substrate 513, thereby holding the core members 515 in place relative to the conformable substrate 513. Alternatively, the flexible membrane 517 may not be attached to the core members 515 but rather only to the conformable substrate 513. While the pockets 519 could be preformed in the conformable substrate 513 to receive the core members 515, the pockets 519 could instead be formed by an elastic deformation of the conformable substrate 513 in the presence of a compressive force applied by the flexible membrane 517 to the core members 515. While the conformable substrate 513 is illustrated with multiple pockets 519 in FIG. 15, a single pocket may instead be provided to receive multiple core members 515. If the layers of the protective guard 511 are attached to one another, attachment may be accomplished by a bonding agent or any other adhesive or gel, sewing means, ultrasonic means, heat means, or any other fastening means.

Referring again to FIGS. 13-15, the flexible membrane 317, 417, and 517 may be any flexible material that is capable of being attached to either the conformable substrate or the central core. In one embodiment, the flexible membrane may be a flexible fabric made from natural fabrics including, without limitation, wool, cotton, silk, leather, or linen; or synthetic fibers including, without limitation, acetate, acrylic, latex, spandex, nylon, polyester, rayon; or blends of the above-mentioned fabrics; or any other material that includes natural and/or synthetic fibers that have been weaved, felted, knitted, crocheted, or otherwise arranged. The fabrics may be flame or fire retardant or resistant, such as for example, NOMEX®.

It is important to note that the membranes, fabrics, conformable substrates, skeletal plates, core members, covers, and backings described herein may be bonded, layered, or connected in part or total to one another or may be layered but not bonded. While the illustrative embodiments described herein have been generally described as including single layers of each component (e.g., conformable substrate, core members, membranes) of the protective guard, any guard or other device incorporating these components may include multiple layers of one or more of the components. Furthermore, for a particular component that is provided in multiple layers, the multiple layers of the component may be arranged adjacent to one another, or may be arranged such that one or more layers of a different component is intermediately disposed between the multiple layers.

In use, the protective guard 11, 111, 211 of the present invention provides impact protection for an extremity or other body part of a person. As shown in FIG. 2, the protective guard 11 is conformable to the shin and lower leg 61 of a person. The conformable substrate 13 and the central core 15 combine to provide superior impact protection. While the conformable substrate 13 by itself is conformable to a leg or other body part, the more rigid characteristics of the material used in the central core 15 would normally not be easily conformable to the person's leg. However, by separating the central core 15 into a plurality of core members 31 and by allowing the core members 31 to be rotationally movable relative to one another, the central core 15 as a whole is also conformable to the leg of the person. The hinges 33 of the central core 15 provide additional impact resistance for point loads and impacts since the hinges are capable of transmitting impact forces to adjacent core members 31. An attachment aperture 65 is provided on each side of the conformable substrate 13 to allow protective guard 11 to be attached to the person's leg with a strap 67 routed through the attachment aperture 65. An ankle guard 71 may also be provided to wrap around the ankle of the person. The ankle guard 71 could include a central core, but preferably is formed solely from the conformable substrate used with protective guard 11, 111, 211. Similarly, the protective guard itself could be formed solely from the conformable substrate and used without the central core. If only the conformable substrate is used, the material may be thicker in areas of predicted impact or may be formed from two or more elastomers having different durometers (i.e. a multi-durometer conformable substrate).

Figure 16:
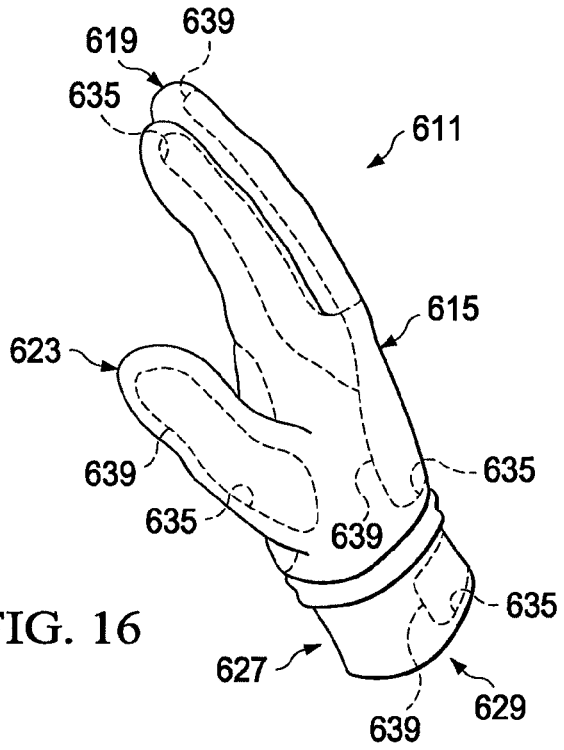
FIG. 16 depicts a side view of a glove having a central core according to an illustrative embodiment.
Figure 17:
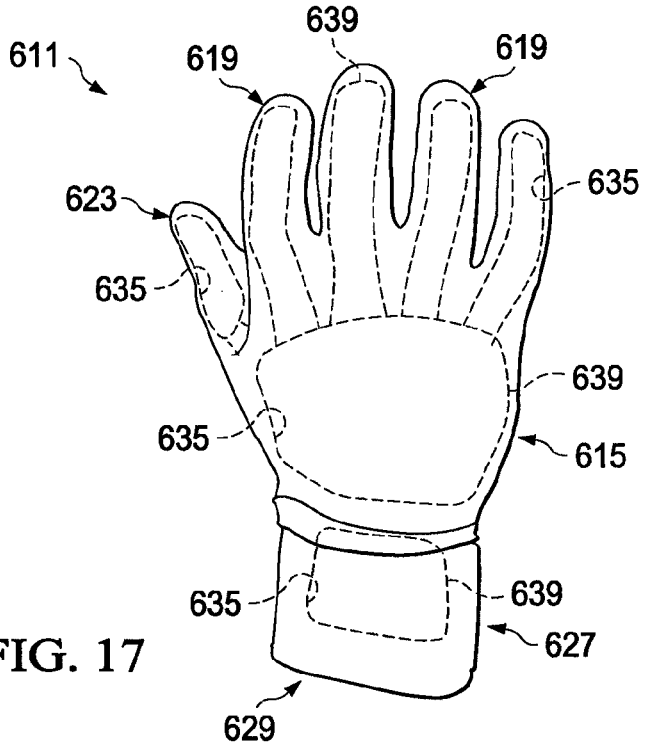
FIG. 17 illustrates a rear view of the glove of FIG. 16.

Referring to FIGS. 16 and 17, a glove 611 having a central portion 615, a plurality of finger portions 619; a thumb portion 623, and a wrist portion 627 includes an opening 629 for insertion of a hand. In at least one of or all of the central portion 615, the plurality of finger portions 619, the thumb portion 623, and the wrist portion 627, a pocket 635 may be provided to receive a central core 639 having a plurality of core members connected by hinges as previously described herein. The core members and hinges allow multi-directional movement of the portions of the hand positioned adjacent the central core in each of the central portion 615, the plurality of finger portions 619, the thumb portion 623, and the wrist portion 627. The central core 639 may be a single article that is shaped to fit into multiple of the portions of the glove 611 containing a pocket. Alternatively, an individual central core 639 may be placed in each individual pocket 635 of the glove 611. When pockets are provided, the central core may be positioned within, embedded, partially-embedded, free-floating, adhesively secured, bonded, sewn or otherwise attached as previously described herein. In another embodiment, the pockets 635 of the glove 611 may be eliminated, and the central core 639 or multiple central cores 639 may be secured to an exterior or interior surface of the glove in the region of the central portion 615, the plurality of finger portions 619, the thumb portion 623, and/or the wrist portion 627. As previously described with respect to the flexible membranes of FIGS. 13-15, a flexible membrane may be positioned over the central core 639 to assist in joining the central core 639 to the glove material.

The glove 611 may be used for protection from impact and other potentially detrimental forces encountered in any sports or other activity. For example, inclusion of a central core 639 in the central portion 615 and finger portions 619 over the back of the hand may be desirable for baseball gloves to protect batters from impact by a baseball. A central core 639 may be positioned over the palm of the hand in the central portion 615 to protect motorcyclists, bicyclists, and skaters from impact and abrasive frictional forces that may be caused when the hands are used to cushion an impact with the ground.

Figure 18:
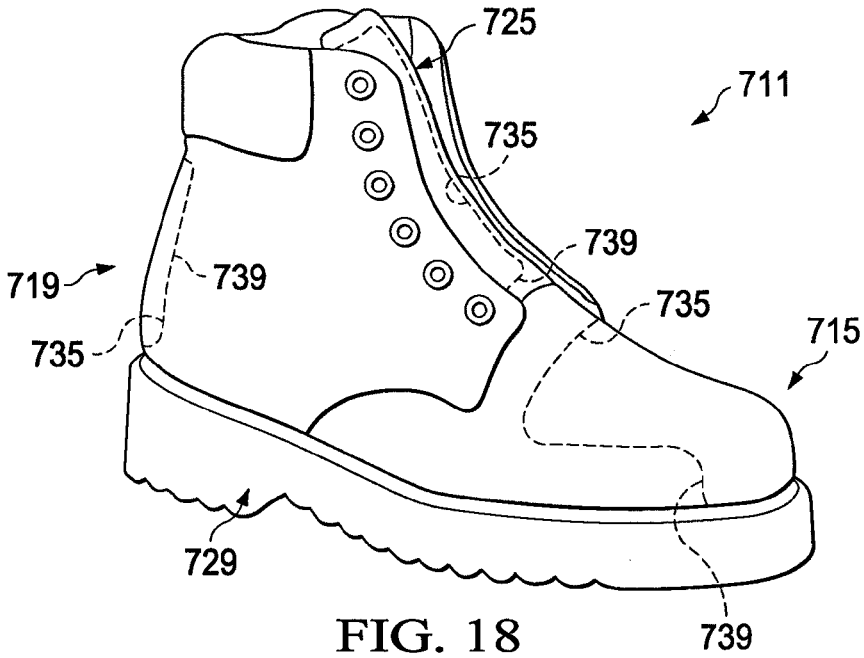
FIG. 18 depicts a perspective view of an article of footwear having a central core according to an illustrative embodiment.
Figure 19:
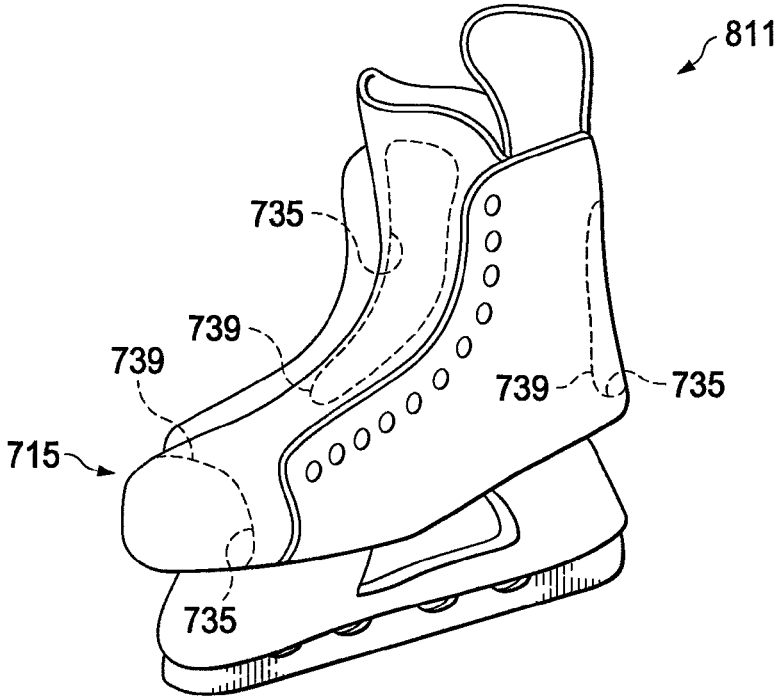
FIG. 19 illustrates a perspective view of an article of footwear having a central core according to an illustrative embodiment.

Referring to FIGS. 17 and 18, an article of footwear, such as for example a work boot 711 or a hockey skate 811, includes a toe portion 715, a heel portion 719, a tongue portion 725, an outsole 729, and an insole (not shown). In at least one of or all of the toe portion 715, the heel portion 719, the tongue portion 725, the outsole 729, and the insole, a pocket 735 may be provided to receive a central core 739 having a plurality of core members connected by hinges as previously described herein. The core members and hinges allow multi-directional movement (i.e., rotational movement about more than one axis) of the portions of the foot positioned adjacent the central core in each of the toe portion 715, the heel portion 719, the tongue portion 725, the outsole 729, and the insole. The central core 639 may be a single article that is shaped to fit into multiple of the portions of the footwear 711, 811 containing a pocket. Alternatively, an individual central core 739 may be placed in each individual pocket 735 of the footwear 711, 811. When pockets are provided, the central core may be positioned within, embedded, partially-embedded, free-floating, adhesively secured, bonded, sewn or otherwise attached as previously described herein. In another embodiment, the pockets 735 of the footwear 11 may be eliminated, and the central core 739 or multiple central cores 739 may be secured to an exterior or interior surface of the footware in the region of the toe portion 715, the heel portion 719, the tongue portion 725, the outsole 729, and/or the insole. As previously described with respect to the flexible membranes of FIGS. 13-15, a flexible membrane may be positioned over the central core 739 to assist in joining the central core 739 to the footwear material.

The footwear 711 may be used for protection from impact and other potentially detrimental forces encountered in any sports or other activity. For example, inclusion of a central core 739 in the tongue portion 725 of the hockey skate 811 provides significant protection to goalies from hockey-puck impacts. Similarly, a central core 639 may be positioned in the toe portion 715 or heel portion 719 of the work boot 711 to protect against impacts received in industrial or other work-related settings.

It should be noted that the protective guards described herein may be used to protect body parts other than the lower legs, hands, or feet of a person including without limitation the torso, back, forearms, wrists, elbows, thighs, knees, shoulders, chest, face, head, and other extremities. In one example, the central core or protective guard may be combined with helmets or other headwear to protect the head from impact. Body parts may also be protected by combining a central core such as that described herein with clothing, either by sewing the central core to the clothing, within a pocket of the clothing, or by otherwise attaching the central core to the clothing. For example, the central core or protective guard may be combined with shirts, jackets, shorts, pants, hats or other articles of clothing.

The protective guards described herein may also be used to protect body parts of non-human animals as well, or alternatively, non-living articles or equipment. For example, the central cores may be attached or incorporated as described herein to luggage, briefcases, computer travel bags, gun cases, or other bags and storage containers to protect the contents therein. In another example, the central core or protective guard may be attached to or incorporated within athletic flooring, subflooring, or ground covering to provide support and impact resistance. The central cores may be attached to or incorporated into the fabric of clothing to protect various areas of human or other animal bodies. While the protective guards and central cores described herein are often presented as being incorporated into sports and work-related equipment, it should be recognized that the use of these elements may be expanded beyond these particular uses. For example, one or more central cores may be attached to or incorporated into various medical devices such as splints and casts. The inclusion of the central core in these devices would provide additional protection against impact and other forces for the body parts to which the splints and casts are applied. One non-medical example may include attachment or incorporation of one or more central cores to an airplane seat, a car seat, or other seat to create a support frame that prevents impression in the foam or other substrate underlying or overlying the core member. The central core may also protect a user of the seat against impact and other forces. Similarly, the central core could be combined with bed mattresses or other bedding materials to provide support and to prevent impressions in the bedding. As can be seen from the preceding examples, the application of the protective guards and central cores described herein are not limited and may include any application where it is desired to protect humans, animals, or non-living articles or equipment from impact and other forces.

In one additional example, the protective guards described herein may be used to protect hips and other body parts from impact during falls. Hip fractures and other broken bones due to falls result in serious injuries and medical complications for many elderly people. Attachment of the protective guard over a person's hip may help prevent some of these injuries.

In one example, a flexible material, such as a surgical tape with an adhesive backing, may be applied to the skin of a patient adjacent the hip. On an outward facing side of the flexible material, one component of a hook-and-loop material may be positioned. A protective guard having a central core such as those described herein may be removably attached to the flexible material using another component of the hook-and-look material that is positioned on the protective guard. The protective guard may be easily replaced, repositioned, or removed for the comfort and safety of the patient. While the protective guard may include both a conformable substrate and a central core, in one embodiment, the central core may be attached to the flexible material or directly to the patient without the use of a conformable substrate. While attachment has been described as using complementary hook-and-loop type material, any fastening means may be used including, without limitation, adhesives, sewing, or other suitable attachment means.

It should be apparent from the foregoing that an invention having significant advantages has been provided. While the invention is shown in only a few of its forms, it is not just limited but is susceptible to various changes and modifications without departing from the spirit thereof.

I claim:

1. A shin guard for protecting a shin of a person comprising:

an elastomeric substrate;

a central core having a plurality of rigid plates disposed on or adjacent to the elastomeric substrate, a first edge of a first one of the plurality of plates being hingedly attached to another plate in the plurality of plates substantially adjacent to the first one of the plurality of plates, wherein each hingedly attached edge of the first one of the plurality of plates joins less than the entire respective hingedly attached edge to an edge of a corresponding other substantially adjacent plate in the plurality of plates; and a flexible fabric membrane comprised of natural or synthetic fibers positioned adjacent to at least one of the elastomeric substrate and the central core.

2. The shin guard according to claim 1, wherein each of the plates is joined by at least one hinge to another of the plates.

3. The shin guard according to claim 2, wherein the joining of the plates allows multidirectional rotation of the central core such that the central core, the elastomeric substrate, and the flexible fabric material are conformable to the shin of the person.

4. The shin guard according to claim 1, wherein:

a pocket is disposed on a surface of the elastomeric substrate; and the central core is at least partially embedded within the pocket.

5. The shin guard according to claim 4, wherein:

the pocket is accessible through an entry slot to allow insertion and removal of the central core; and the central core is fully embedded within the pocket such that a substantially flat impact surface is created when the fabric is adjacent to the at least one of the elastomeric substrates and the central core.

6. The shin guard according to claim 1, wherein the first edge of the first one of the plurality of plates is hingedly attached to another plate in the plurality of plates by a hinge and the hinge is a living hinge formed from the same material as the rigid plates.

7. The shin guard according to claim 1, wherein the first plate is hingedly attached to the other plate by a hinge bonded to the first and other plates.

8. The shin guard according to claim 7, wherein the hinge comprises a membrane having adhesive disposed on at least one surface of the membrane.

9. The shin guard according to claim 1, wherein the plates are hexagonal in shape.

10. The shin guard according to claim 9, wherein:

some of the rigid plates are disposed in an outer perimeter region and others of the rigid plates are disposed in an inner region; and each of the rigid plates in the inner region is hingedly attached on each of six edges to an adjacent rigid plate.

11. The shin guard according to claim 1, wherein the fabric is adhesively bonded to at least one of the elastomeric substrates and the central core.

12. A protective guard for protecting a person comprising:

a conformable substrate;

a plurality of rigid core members disposed adjacent to a surface of the conformable substrate, a first edge of a first one of the plurality of members being hingedly attached to another member in the plurality of members substantially adjacent to the first one of the plurality of plates, wherein each hingedly attached edge of the first one of the plurality of members joins less than the entire respective hingedly attached edge to an edge of a corresponding other substantially adjacent member in the plurality of members, and the plurality of rigid core members are arranged such that the first of the core members is rotationally movable about at least one axis relative to other substantially adjacent members in the plurality of members; and a flexible fabric membrane comprised of natural or synthetic fibers positioned adjacent to at least one of the conformable substrate and the plurality of core members.

13. The protective guard according to claim 12, wherein the core members are arranged such that the core members, as a whole, are conformable to the shin of the person.

14. The protective guard according to claim 12, wherein core members are bonded to the conformable substrate.

15. The shin guard of claim 1, wherein the elastomeric substrate is a foam substrate.

16. The protective guard of claim 12, wherein the conformable substrate is adapted to at least partially absorb an impact force.

* * * * *